United States Patent [19]

O'Donnell

[11] Patent Number: 4,703,808

[45] Date of Patent: Nov. 3, 1987

[54] SMOKE ELIMINATOR

[76] Inventor: James W. O'Donnell, 7400 N. Overhill Ave., Chicago, Ill. 60648

[21] Appl. No.: 856,203

[22] Filed: Apr. 28, 1986

[51] Int. Cl.[4] ..... A62C 31/22

[52] U.S. Cl. ..... 169/91; 239/276; 248/217.3; 98/42.03; 98/42.05

[58] Field of Search ..... 239/271, 272, 531, 532, 239/280, 276; 285/192; 248/75, 74.5, 67.5, 216.1, 217.3; 169/70, 51, 91; 98/42.03, 42.05

[56] References Cited

U.S. PATENT DOCUMENTS

| | | | |
|---|---|---|---|
| 2,017,369 | 10/1935 | McGhee | 7/17 |
| 2,813,753 | 11/1957 | Roberts | 169/70 X |
| 2,857,005 | 10/1958 | Medlock | 169/52 X |
| 3,780,811 | 12/1973 | Yao | 169/91 X |
| 3,888,535 | 6/1975 | Rosso | 294/19 R |
| 4,168,748 | 9/1979 | Batte | 169/70 X |
| 4,187,913 | 2/1980 | Wilcox | 239/282 X |
| 4,319,851 | 3/1982 | Arthur | 401/137 |
| 4,502,806 | 3/1985 | Albertson | 401/137 |

FOREIGN PATENT DOCUMENTS

| | | | |
|---|---|---|---|
| 873766 | 6/1971 | Canada | 239/532 |
| 86904 | 2/1959 | Denmark . | |

*Primary Examiner*—Andres Kashnikow
*Assistant Examiner*—Kevin Patrick Weldon
*Attorney, Agent, or Firm*—Thomas W. Tolpin

[57] ABSTRACT

A smoke eliminator for removing smoke, heat and combustion gases from a burning structure. The smoke eliminator includes a heat-resistant rigid tube having an adapter attached to one end for connection to a conventional fire hose, and a fog nozzle attached to the other end and disposed normal to the tube. A butt section is disposed at right angles to the tube below the fog nozzle and has a number of holding teeth for engaging a structure member such as a window ledge.

2 Claims, 3 Drawing Figures

SMOKE ELIMINATOR

TECHNICAL FIELD

This invention relates to a firefighting tool and more particularly to a device for eliminating smoke, heat and combustion gases from a burning structure.

BACKGROUND ART

During the course of fighting fires, one of the serious hazards encountered by the firefighters is the presence of smoke, fire gases, heat and flames in the burning structure. Although protective clothing and respirators have to be used to allow the firemen to work in the presence of these hazards, no firefighting device has been provided which removes or eliminates these hazards from the burning structure.

Those concerned with these and other problems recognize the need for an improved smoke eliminator.

DISCLOSURE OF THE INVENTION

The present invention provides a smoke eliminator for removing smoke, heat and combustion gases from a burning structure. The smoke eliminator includes a heat-resistant rigid tube having an adapter attached to one end for connection to a conventional fire hose, and a fog nozzle attached to the other end and disposed normal to the tube. A butt section is disposed at right angles to the tube below the fog nozzle and has a number of holding teeth for engaging a structural member such as a window ledge.

Upon arriving at a burning structure, the firefighter positions the smoke eliminator by using the butt section to break a window and clear the glass out of the window opening. The smoke eliminator is then positioned in the center of the window opening and the holding teeth engage the window ledge to secure the unit in position. A fire hose is connected to the lower end of the tube and the fog nozzle emits a water fog that is directed away from the structure. The water fog creates a suction and aspirates the smoke, heat, and fire gases from the structure, while simultaneously setting up a water curtain for protection of adjacent structures. Once positioned and connected to a water line, the smoke eliminator is an un-manned apparatus.

An object of the present invention is the provision of an improved smoke eliminator.

Another object is to provide a smoke eliminator that is safely and conveniently used.

A further object of the invention is the provision of a smoke eliminator that is simple in structure and inexpensive to manufacture and maintain.

Still another object is to provide a smoke eliminator that is installed and operated with a minimum of man power.

A still further object of the present invention is the provision of a smoke eliminator that efficiently and safely removes smoke, heat and combustion gases from a burning structure.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
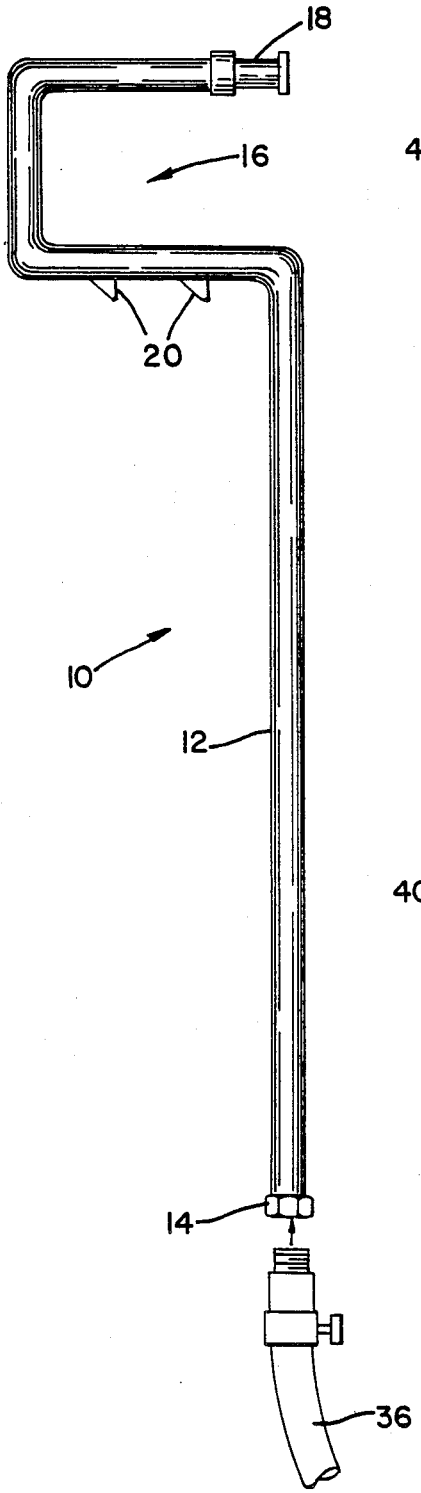
FIG. 1 is a side elevational view of the smoke eliminator of the present invention.

Referring now to the drawings, wherein like reference numerals designate identical or corresponding parts throughout the several views, FIG. 1 shows the smoke eliminator (10) which includes a straight section of rigid tube (12) having a brass swivel adapter (14) attached to the lower end. The upper end of tube section (12) carries a butt section (16) which extends normal to the tube (12) and terminates in a fog nozzle (18). The lower member of the butt section (16) carries a number of holding teeth (20).

Figure 2:
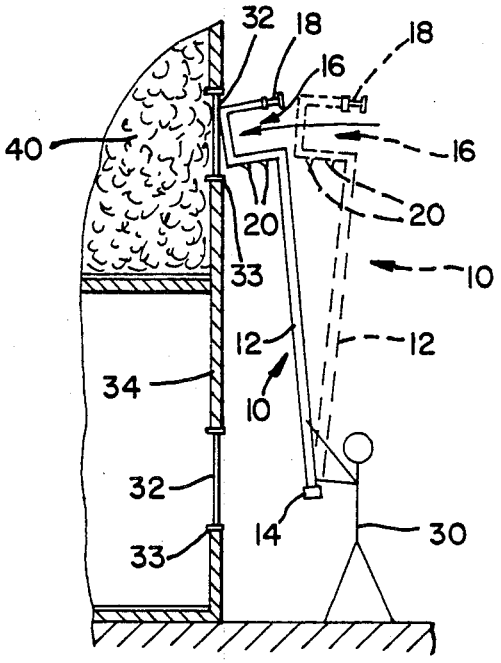
FIG. 2 is a reduced side elevational view illustrating a firefighter positioning the smoke eliminator in a burning structure by breaking through a window opening.
Figure 3:
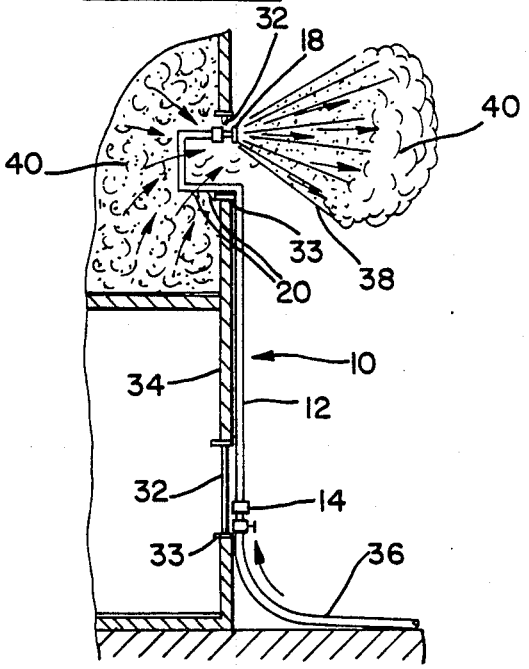
FIG. 3 is a side elevational view similar to FIG. 2, but showing the smoke eliminator in position secured to the structure and connected to a fire hose.

The installation and operation of the smoke eliminator (10) is illustrated in FIGS. 2 and 3. FIG. 2 shows a firefighter (30) using the butt section (16) to break through a window opening (32) in a structural wall (34). When the glass is cleaned from the window opening (32), the smoke eliminator (10) is positioned in the center of the window opening (32) and held in position by engagement of the holding teeth (20) with the window ledge (33).

FIG. 3 shows the un-manned smoke eliminator (10) positioned in the window opening (32) and connected to a conventional fire hose (36). The water fog (38) is emitted from the fog nozzle (18) which has its end positioned adjacent to and directed away from the window opening (32). The suction created by the water fog (38) draws the smoke (40) from the burning structure while at the same time setting up a water curtain for protection of adjacent structures.

It is to be understood that the smoke eliminator can be provided in various tube lengths and diameters and that the tube can be made of various heat resistant rigid materials such as stainless steel and PVC.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A smoke eliminator, comprising:

a substantially rigid tube having an elongated substantially straight upright section and a generally C-shaped butt section, said elongated straight section integrally connected to and communicating with said C-shaped section, said elongated straight section having a lower end and an upper end;

said C-shaped section having a lower lateral arm, an upper lateral arm and an intermediate bight portion extending between and connecting said arms, said intermediate portion being spaced laterally from and substantially above said elongated straight section, said lower arm having a connecting portion connected to said upper end of said elongated straight section, and said upper arm having a nozzle attaching portion;

an adapter attached to said lower end of said elongated straight section for connection to a hose;

a substantially stationary nozzle attached to said nozzle attaching portion of said upper arm of said C-shaped, said nozzle facing laterally in a direction generally transverse to said elongated upright section for discharging a water spray away from the inside of a burning building to help evacuate and discharge the smoke from said burning building; and at least one stationary tooth attached to and extending downwardly from said lower arm of said C-shaped butt section for mounting said C-shaped section on a window ledge of the burning building.

2. The smoke eliminator of claim 1 wherein said intermediate portion of said C-shaped butt section is substantially vertical and parallel to said elongated upright section and said arms of said C-shaped butt section are substantially perpendicular to said elongated upright section.

* * * * *